US006409424B1

(12) United States Patent
Crupi

(10) Patent No.: US 6,409,424 B1
(45) Date of Patent: Jun. 25, 2002

(54) ASPHALT RAKE WITH RIDE UP CAPABILITY

(76) Inventor: Francesco A. Crupi, 2845 Seabreeze Dr. South, Gulfport, FL (US) 33707

( * ) Notice: Subject to any disclaimer, the term of this patent is extended or adjusted under 35 U.S.C. 154(b) by 0 days.

(21) Appl. No.: 09/592,773

(22) Filed: Jun. 13, 2000

(51) Int. Cl.[7] ..... E01C 23/12

(52) U.S. Cl. ..... 404/94; 404/92; 404/93; 299/36.1; 172/684.5

(58) Field of Search ..... 404/90, 91, 92, 404/93, 94, 95, 101, 118; 299/36.1, 36.8; 172/193, 197, 684.5, 624.5, 260.5, 263, 833

(56) References Cited

U.S. PATENT DOCUMENTS

| | | | | | |
|---|---|---|---|---|---|
| 2,371,549 | A | * | 3/1945 | Sembler et al. | 299/36.1 |
| 2,686,982 | A | * | 8/1954 | Leliter | 299/36.1 |
| 2,783,699 | A | * | 3/1957 | Kelley | 172/463 |
| 2,838,858 | A | * | 6/1958 | Conrad | 299/36.1 |
| 3,470,964 | A | * | 10/1969 | West et al. | 172/197 |
| 3,662,840 | A | * | 5/1972 | Richey | 172/260.5 |
| 3,880,243 | A | * | 4/1975 | Gurries et al. | 172/784 |
| 3,901,326 | A | * | 8/1975 | Geurts | 172/260.5 |
| 3,907,450 | A | * | 9/1975 | Cutler | 404/90 |
| 3,989,401 | A | | 11/1976 | Moench | 404/95 |
| 4,300,853 | A | | 11/1981 | Jones | 404/92 |
| 4,317,642 | A | | 3/1982 | Wirtgen | 404/72 |
| 4,335,974 | A | | 6/1982 | Wirtgen | 404/92 |
| 4,601,605 | A | * | 7/1986 | Damp et al. | 404/95 |
| 4,660,652 | A | * | 4/1987 | Moos et al. | 172/260.5 |
| 4,780,022 | A | | 10/1988 | Ohiba et al. | 404/90 |
| 4,793,733 | A | * | 12/1988 | Chiba et al. | 404/90 |
| 4,967,850 | A | * | 11/1990 | Bargfrede et al. | 172/197 |
| 5,000,615 | A | | 3/1991 | Murray | 404/75 |
| 5,002,426 | A | | 3/1991 | Brown et al. | 404/92 |
| 5,046,890 | A | | 9/1991 | Dickson | 404/90 |
| 5,219,450 | A | | 6/1993 | Thurk | 404/91 |
| 5,265,975 | A | * | 11/1993 | Scott | 404/94 |
| 5,407,013 | A | * | 4/1995 | Scott | 172/762 |
| 5,407,014 | A | * | 4/1995 | Tranmer | 172/197 |
| 5,535,832 | A | * | 7/1996 | Benoit | 172/195 |
| 5,669,451 | A | * | 9/1997 | Noonan et al. | 172/624.5 |
| 5,797,460 | A | * | 8/1998 | Parker et al. | 172/624.5 |
| 5,833,011 | A | * | 11/1998 | Boertlein | 172/197 |

OTHER PUBLICATIONS

Francesco A. Crupi, co–pending U.S. Patent Application S/N 09/592,398 entitled "Mixing Apparatus and Method for Blending Milled Asphalt with Rejuvenating Fluid," filed Jun. 13, 2000, in its entirety.

Francesco A. Crupi, co–pending U.S. Patent Application S/N 09/593,621 entitled "Method and Apparatus for Controlling the Mixing of Milled Asphalt Aggregate with Rejuvenating Fluid," filed Jun. 13, 2000, in its entirety.

* cited by examiner

*Primary Examiner*—H. Shackelford
*Assistant Examiner*—Alexandra K Pechhold
(74) *Attorney, Agent, or Firm*—Butler, Snow, O'Mara, Stevens & Cannada, PLLC

(57) ABSTRACT

A raking device for breaking up a surface has a plurality of rakes mounted on a rake frame and arranged to produce an upwardly directed result in force in response to a horizontally directed force arising from encountering an obstruction in a path of travel of the raking device. A rake frame support mounts the rack frame to a rake frame carrier structure and allows controlled movement of the rakes in a vertical direction. A force applicator acting between the rake from carrier and the rake frame support is provided to apply at least a downward force to the rake. The force applicator is responsive to an increase in the upwardly directed result in force above a preset amount to allow the rakes to move upwardly in response to the increase in force.

19 Claims, 5 Drawing Sheets

ASPHALT RAKE WITH RIDE UP CAPABILITY

FIELD OF THE INVENTION

This invention relates to apparatus for in situ rejuvenation of asphalt pavement. More particularly this invention relates to a rake associated with such apparatus for initially breaking up an asphalt surface after heating by a heater stage of such apparatus.

BACKGROUND OF THE INVENTION

Asphalt pavement consists essentially of an aggregate and sand mixture held together with a petroleum based binder, such as tar. With continued exposure to sun, moisture, traffic, freezing and thawing, asphalt surfaces degrade. The degradation is principally in the binder, rather than the aggregate and sand mixture which makes up the bulk of the asphalt. Also, much of the degradation occurs within the top two or three inches of the surface.

Traditionally, worn asphalt pavement was not restored but instead was torn up and replaced with new asphalt. This is a costly approach and creates a problem as to what to do with the torn up pavement. Accordingly, techniques and apparatus have been developed for restoring or rejuvenating the top few inches of an asphalt paved surface.

A typical road resurfacing apparatus has a heater for heating and softening the asphalt surface as it passes along the asphalt surface. Following the heater is a "rake" or "scarifier" which breaks up or "scarifies" the softened pavement. The scarified pavement is generally crushed or "milled", blended with rejuvenating fluid and optionally additional sand or aggregate and redeposited. The redeposited material is spread out and rolled to create a rejuvenated surface comparable in quality to the original surface before degradation.

Asphalt paved surfaces generally include embedded objects such as access covers and culverts which interfere with the raking operation. As rake designs have heretofore lacked the ability to "ride-up" over solid objects, it has been necessary to stop raking and raise the rakes until the object was cleared. This necessitated separate treating of the areas around such obstacles and the risk of damaging the rakes if they weren't raised in time.

It is an object of the present invention to provide a raking device for breaking up a surface which has the capability of riding up over obstacles.

SUMMARY OF THE INVENTION

A raking device for breaking up a surface has a plurality of rakes mounted on a rake frame and arranged to produce an upwardly directed resultant force in response to a horizontally directed force arising from encountering an obstruction in a path of travel of the raking device. A rake frame support mounts the rake frame to a rake frame carrier structure and allows controlled movement of the rakes in a vertical direction. A force applicator acting between the rake frame carrier and the rake frame support is provided to apply at least a downward force to the rake. The force applicator is responsive to an increase in the upwardly directed resultant force above a preset amount to allow the rakes to move upwardly in response to the increase in force.

The rake frame support may include at least one linkage member pivotally connected to the rake frame and to the rake frame carrier. The force applicator may include a fluid pressure responsive piston slidably received within a bore and connected to the linkage member to apply the downward force in response to fluid pressure within the bore. The rakes may include a downwardly depending spring secured at a frame end to the rake frame, and a rake tip secured to the rake spring at a tip end of the rake spring, distal the frame end. In use, the frame end leads the tip end.

A fluid pressure supply system connected to the bore through a first fluid conduit may supply the pressurized fluid at a predetermined pressure and flow rate to act on a first face of the piston and cause the piston to exert the downward force. The fluid pressure supply system includes a fluid pressure bleed passage through which a portion of the pressurized fluid being supplied through the first fluid conduit to the bore is continually bled off at a volume flow rate determined by the pressure of the pressurized fluid. The fluid pressure bleed passage allows an increase in the volume flow rate therethrough in response to an increase in pressure as would be occasioned by the piston responding to an increase in the resultant force exerted by the rakes. In this manner, the rakes are enabled to move upwardly in response to an increase in the horizontally directed force.

A plurality of rake frames may be used and the rake frames may be pivotally mounted to allow rocking of the rake frames about a horizontal axis generally parallel to the path of travel of the rakes. The rake frame support may be a parallel bar linkage including at least two laterally extending generally parallel bars pivotably connected, one above the other, to the rake frame at one end and to the rake frame carrier at an opposite end.

Alternatively, the linkage may be a bell crank having a first end pivotably connected to the rake frame, a second end opposite the first end pivotably connected to the force applicator and further pivotably connected between its first and second ends to the rake frame carrier.

DESCRIPTION OF THE DRAWINGS

Preferred embodiments of the present invention are described below with reference to the accompanying drawings in which.

DESCRIPTION OF PREFERRED EMBODIMENTS

Figure 1:
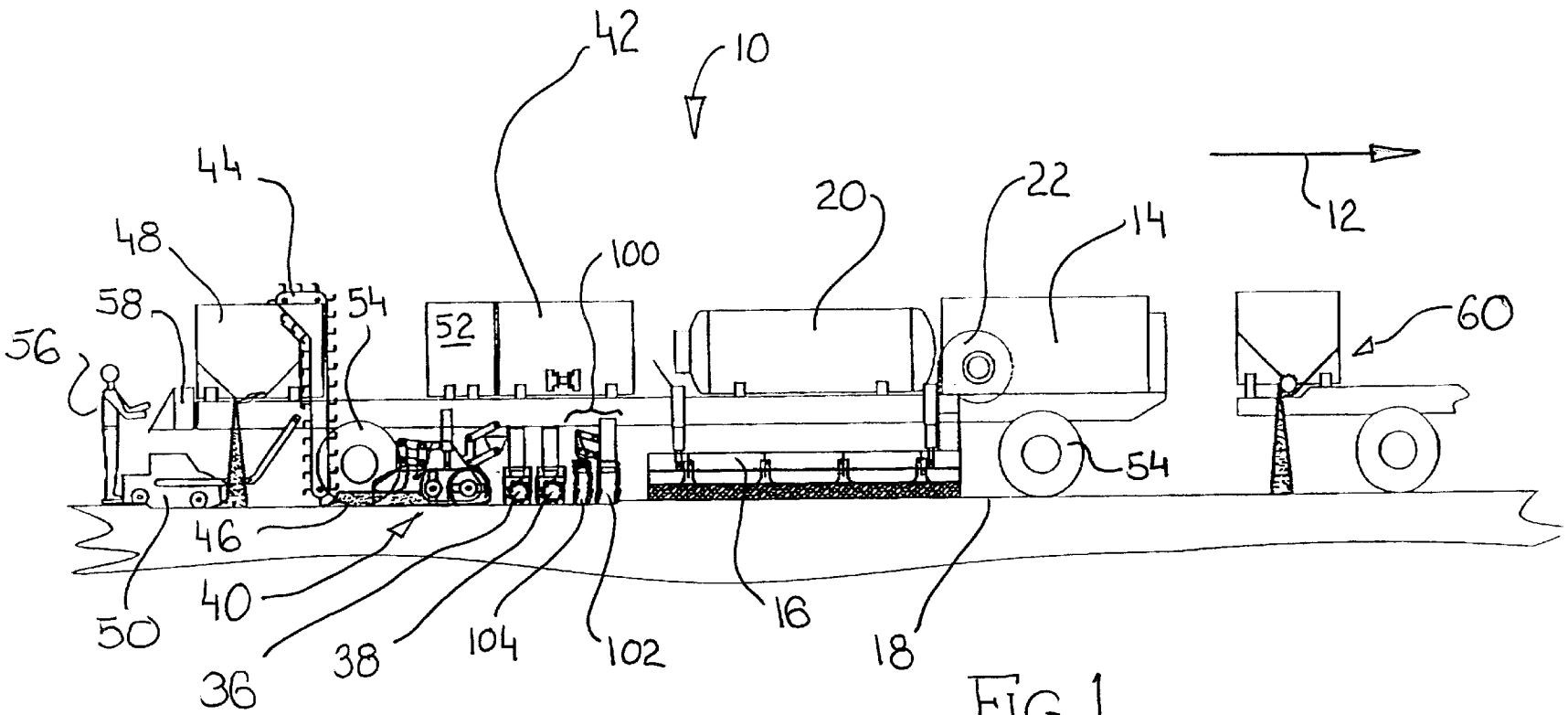
FIG. 1 is a schematic illustration of an asphalt resurfacing apparatus incorporating a raking device according to the present invention.
Figure 2:
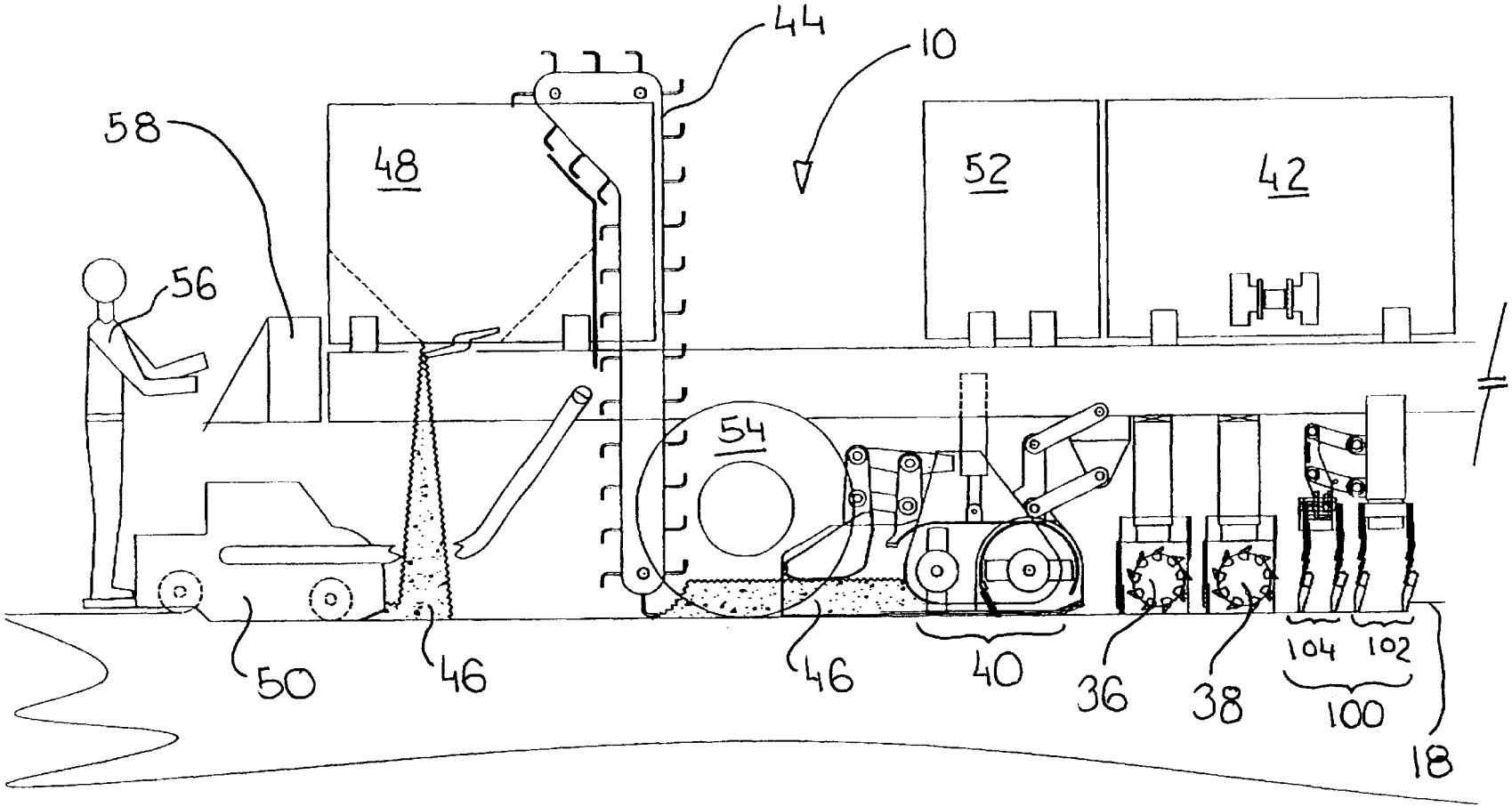
FIG. 2 is an enlarged schematic illustration of the rearward portion of the asphalt resurfacing apparatus illustrated in FIG. 1.

An asphalt rejuvenating apparatus is generally indicated by reference 10 in FIG. 1. The rejuvenating apparatus 10 travels in a path of travel indicated by arrow 12. A power plant 14 at the front is provided to drive the apparatus and typically includes an engine and a hydraulic system.

Behind the power plant 14 is a heater box 16 which includes numerous burners and associated plumbing for heating an asphalt surface 18 upon which the rejuvenating apparatus 10 travels. A propane (or other combustible fuel) tank 20 and a combustion blower 22 would typically be provided. The heater box 16 directs heat at the asphalt surface 18 to cause softening of an upper part of the asphalt surface 18.

The softened asphalt surface 18 is initially dislodged by a raking device, generally indicated by reference 100 which follows the heater box 16. The raking device 100 at which this invention is directed is described in more detail below, after a brief overview of the overall layout and operation of the asphalt rejuvenating apparatus 10. The rakes 100 dislodge the heated asphalt surface 18. The rakes 100 may include main rakes 102 and extension rakes 104, the extension rakes 104 performing a similar function to the main rakes 102, but to the outside edges. The main rakes 102 break up material around manholes where a main mill 36 behind the rakes 100 cannot run.

The main mill 36 grinds up the material dislodged by the rakes, levels the underlying surface and prepares the surface to a preset depth. Extension mills 38 ahead of the main mill 36 perform a similar function, but process outer material typically from 10 to 15 feet to each side of the rejuvenating apparatus 10 and move it to a central part of the rejuvenating apparatus 10 where it is subsequently processed by the main mill 36.

A pug mill 40 follows the main mill 36 and mixes the processed material from the main mill 36 with rejuvenating fluid from a tank 42. Blended material 46 from the pug mill 40 is picked up by a scalping conveyor 44 which deposits the blended material 46 in a heated holding hopper 48. The holding hopper 48 keeps the blended material 46 hot until it is needed. The holding hopper 48 may be filled through its top with material for start ups or if additional material is needed. The holding hopper 48 may also be dumped if required or at the end of a day's operation.

A screed 50 follows the asphalt rejuvenating apparatus 10 and may be a unit such as typically found on an asphalt paver. The screed 50 lays, spreads and slightly compacts the blended material 46 for final rolling.

A water system 52 may be provided to supply cooling water to front and rear tires or tracks 54.

An operator 56 operates a control and processing station 58. From initial core samples the amount of rejuvenating fluid, sand and aggregate required to bring the asphalt surface 18 up to a suitable specification can be determined. The operator 56 can input and monitor the amounts of rejuvenating fluid, sand and aggregate being added.

A sand/aggregate bin 60 precedes the asphalt rejuvenating apparatus 10. The sand/aggregate bin 60 may be attached to the asphalt rejuvenating apparatus 10 or attached to a separate machine (not shown) running in front thereof. Sand/aggregate is metered at a specific rate which is a function of ground speed and specification requirements.

The raking device 100 and its operation will now be described in more detail, with reference principally to FIGS. 3, 4 and 5.

The raking device 100 has a plurality of rakes 106 mounted on a rake frame 108. Each rake 106 has a downwardly depending rake spring 110 secured at a frame end 112 to the rake frame 108. A rake tip 114 is secured to a tip end 116 of the rake spring 110. In use, as illustrated, the frame end 112 of the rakes 106 will lead the tip 114 which as the effect of producing an upwardly directed resultant force in response to a horizontally directed force being applied to the rake tips 114 as the rakes are forced by the asphalt rejuvenating apparatus 10 toward the softened asphalt surface 18. Typically, the rake springs 110 will be rearwardly arched leaf type springs, however, other arrangements and spring types may also prove suitable. For example, a coil or torsion spring might be provided at the juncture of the frame end 112 and the rake frame 108.

Figure 3:
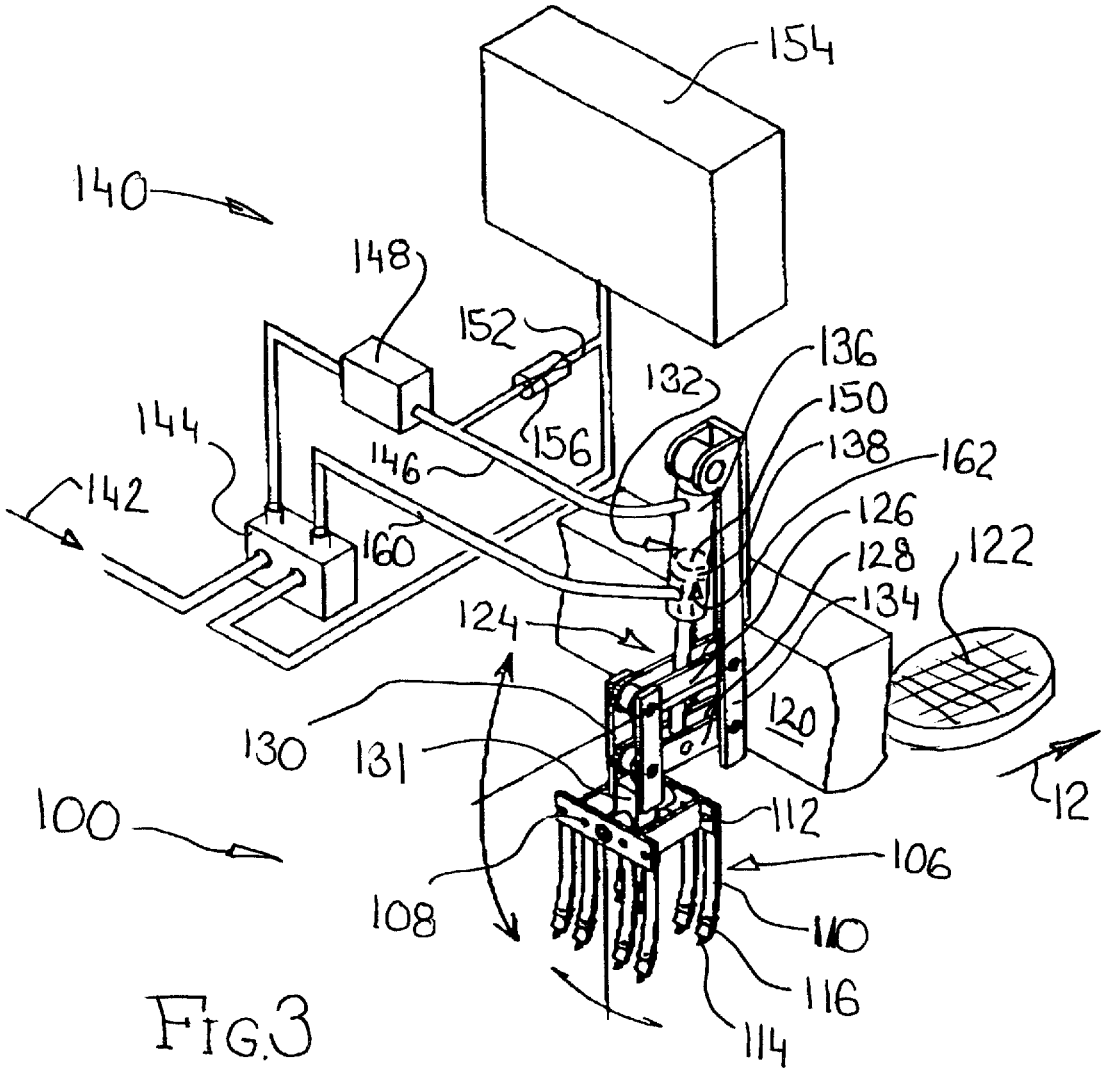
FIG. 3 is a perspective view illustrating a raking device according to the present invention.
Figure 4:
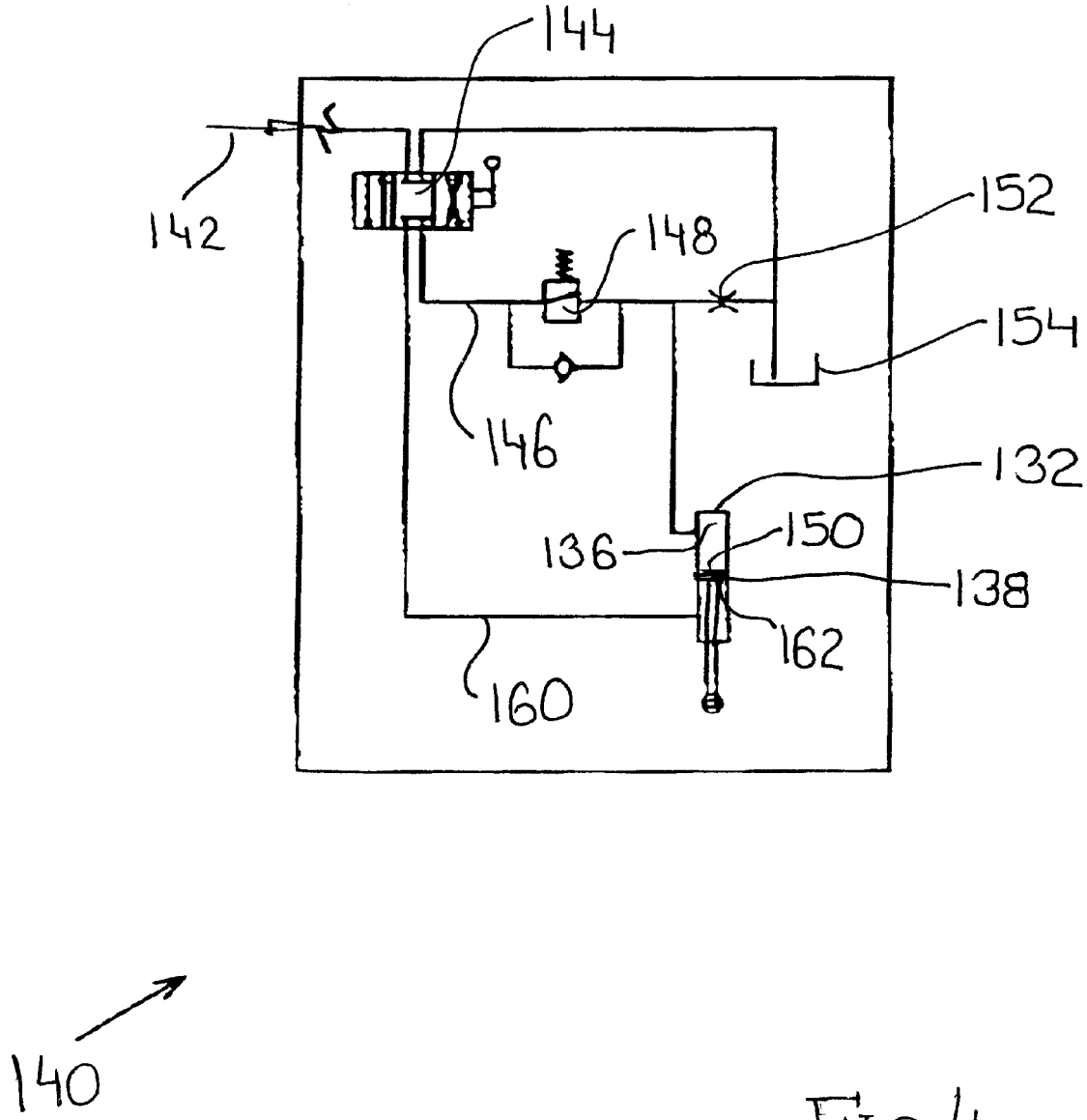
FIG. 4 is a schematic view illustrating a fluid pressure supply system according to the present invention; and, FIG. 5 is a perspective view illustrating an alternate embodiment of a raking device according to the present invention.

Although conceivably only a single rake frame 108 may be used, as a practical matter, a plurality of relatively short rake frames 108 each having a few rakes 106 such as illustrated in FIG. 3 will be arranged side by side along a rake frame carrier 120. The use of a plurality of relatively short rake frames 108 has the advantage of allowing only the respective of the rake frames 108 affected by the respective rakes 106 attached thereto go encountering a solid object 122 to rise over the object. If a single long rake frame 108 were provided, a significant advantage to the ride-up feature would be lost as the heated asphalt surface on either side of the solid object 122 wouldn't be dislodged.

The rake frames 108 are mounted to the rake frame carrier structure 120 by rake frame supports 124 which allow controlled movement of the rake frames 108 and therefore of the rakes 106 in a vertical direction. The rake frame carrier 120 is typically a rigid structure spanning the full width of the asphalt rejuvenating apparatus 10. The rake frame support 120 may be a tubular box-shaped member as illustrated and must be able to withstand the forces imparted thereon in dragging the rakes 106 along the softened asphalt surface 18.

The rake frame support 124 illustrated in FIG. 3 is a parallel bar linkage having upper and lower laterally extending generally parallel bars 126 and 128 respectively. The upper and lower bars 126 and 128 are respectively pivotably connected at one end to the rake frame carrier 120 and at an opposite end to an upright bar 130 extending from a connector link 131 on the rake frame 108.

A hydraulic cylinder 132 is mounted at one end to a bracket 134 rigidly secured to the rake frame carrier 120 and at an opposite end to the rake frame support 124. The hydraulic cylinder acts as a force applicator acting between the rake frame carrier 120 and the rake frame support 124 to apply at least a downwardly directed force to the rakes. The hydraulic cylinder 132 illustrated is a two way cylinder and can therefore also be used to raise the rakes 106.

As will be appreciated by those knowledgeable in hydraulic cylinders, the hydraulic cylinder 132 comprises a cylindrical bore 136 within which is slidably mounted a piston 138 (shown in dashed outline) which moves along the bore in response to fluid pressure. Fluid pressure is supplied by a fluid pressure supply system generally indicated by reference 140 in FIGS. 3 and 4.

The fluid pressure supply system 140 receives pressurized fluid, such as hydraulic fluid, from a pump which may be associated with the power plant 14. Arrow 142 indicates pressurized fluid entering the fluid pressure supply system 140, from where it passes through a control valve 144 which would typically be a three position four way closed centre valve which may be actuatable manually, electrically, hydraulically or pneumatically. In a "lower" position, corresponding to a downwardly directed force being applied to the rakes 106, pressurized fluid is presented to a first fluid conduit 146 and through the first fluid conduit to the bore 136. The pressurized fluid 142 acts on a first face 150 of the piston 134 to cause the piston 134 to exert the downward force on the frame support. The amount of pressure is controllable by varying a pressure reducing valve 148 between the control valve 144 and the first fluid conduit 146. The pressure reducing valve 148 preferably has a free flow bypass.

A fluid pressure bleed passage 152 fluidly communicates with the first fluid conduit 146 and allows a portion of any pressurized fluid passing along the first fluid conduit 146 to be bled off and returned to a fluid reservoir 154. Flow rate through the bleed passage 152 may be determined by an orifice 156 mounted in the fluid bleed passage 152.

It will be appreciated that the downward force exerted by the hydraulic cylinder 132 will be an equilibrium value which is a function of the fluid pressure in the first fluid conduit, as initially determined by the pressure reducing valve 148, less any pressure reduction associated with the bleed off of fluid through the fluid pressure bleed passage 152. Accordingly, barring any increase in upward force such as caused by rakes 106 encountering a solid object 122, the downward force will be substantially constant. If an increase upward force is applied to the hydraulic cylinder 132, such as by the rakes 106 encountering the solid object 122, the pressure in the first fluid conduit 146 will increase which will also cause an increase in fluid flow through the fluid pressure bleed passage 152, accompanied by upward movement of the rakes 106. Pressurized fluid emanating from the pressure reducing valve 148 cannot sustain an increase in fluid pressure beyond the above predetermined equilibrium value. The associated increase in flow through the fluid pressure bleed passage 152 during such increased pressure periods must be sourced from the fluid within the bore 136 of the hydraulic cylinder 132. This will result in a net loss in fluid between the pressure reducing valve 148 and the piston 138 in the hydraulic cylinder which will be accommodated by the upward movement (assuming the hydraulic cylinder is oriented as illustrated) of the piston 138.

If it is desired to raise the rakes 106, for example, for transport of the asphalt rejuvenating apparatus 10, a second fluid conduit 160 may be provided to supply pressurized fluid to a second face 162 of the piston 138, which is opposite the first face 150. The control valve 144 may be used to direct the pressurized fluid into the second fluid conduit 160 rather than the first fluid conduit 146.

Figure 5:
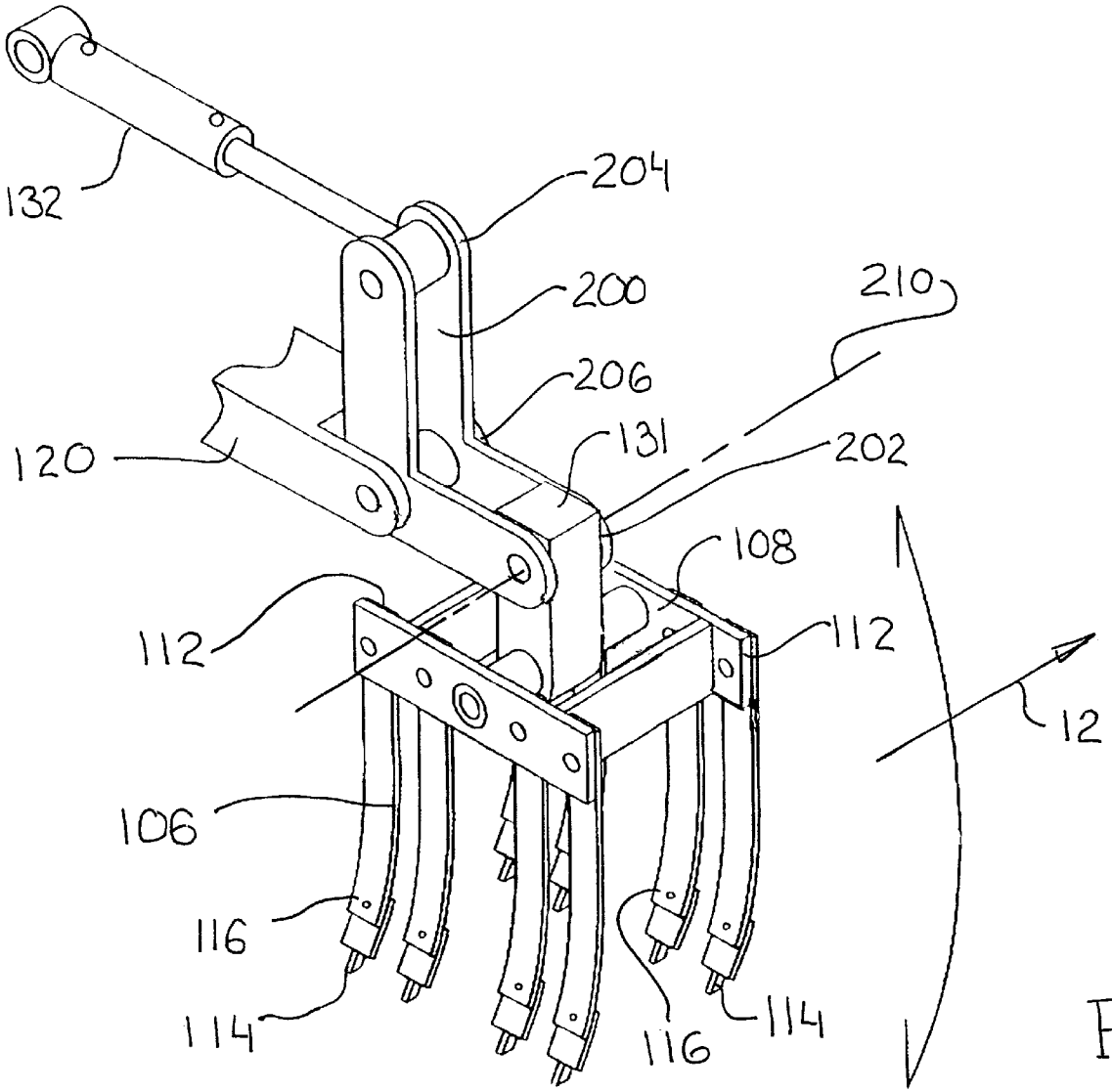

FIG. 5 illustrates an alternate arrangement for a rake frame support linkage member, generally indicated by reference 200. As the rake frame 108 and rakes 106 are similar to those depicted in FIG. 3, like reference numerals have been used and the corresponding description above applies. The linkage member 200is basically a bell crank having a first end 202 pivotably connected to the connector link 131. A second end 204 opposite the first end 202 is pivotably connected to the hydraulic cylinder (ie., "force applicator") 132. The bell crank 200 is pivotably connected at a point 206 between the first end 202 and second end 204 to the rake frame carrier 120. The FIG. 5 embodiment is particularly well suited to a rake frame 108 extending from the ends of the rake frame carrier 102, such as for the extension rakes 102.

The rake frames 108 may be pivotably mounted to the connector link 131 as illustrated to allow rocking of the rake frames 108 about a horizontal axis 210 generally parallel to the path of travel 12. Generally about 10 degrees of permissible rotation to either side of the horizontal is desired.

The above description is intended in an illustrative rather than a restrictive sense. Variations may be apparent to those skilled in such structures without departing from the spirit and scope of the present invention as defined by the claims set out below. For example, the orientation of various of the linkages and hydraulic system components may be altered while still resulting in the application of force and movement of the components in the required directions. Although hydraulically actuatable components are envisaged as most preferred for the force applicator 132 fluid pressure supply system, in some lighter duty applications it may be possible to consider pneumatic systems. Although the latter may not be preferable they should not be excluded other than for unsuitability in a selected application of the present invention.

I claim:

1. A raking device for breaking up a surface, said raking device comprising:

a plurality of rakes mounted on a rake frame and arranged to produce an upwardly directed resultant force in response to a horizontally directed force arising from encountering an obstruction in a path of travel of said raking device;

a rake frame support mounting said rake frame to a rake frame carrier structure and allowing controlled movement of said rakes in a vertical direction;

a force applicator acting between said rake frame carrier structure and said rake frame support for applying at least a downward force to said plurality of rakes, said force applicator being responsive to an increase in said upwardly directed resultant force above a preset amount to allow said plurality of rakes to move upwardly in response to said increase.

2. A raking device for breaking up a surface, said raking device comprising:

a plurality of rakes mounted on a rake frame and arranged to produce an upwardly directed resultant force in response to a horizontally directed force arising from encountering an obstruction in a path of travel of said raking device;

a rake frame support mounting said rake frame to a rake frame carrier structure and allowing controlled movement of said rakes in a vertical direction;

a force applicator acting between said rake frame carrier structure and said rake frame support for applying at least a downward force to said plurality of rakes, said force applicator being responsive to an increase in said upwardly directed resultant force above a preset amount to allow said plurality of rakes to move upwardly in response to said increase;

said rake frame support including at least one linkage member pivotally connected to said rake frame and to said rake frame carrier;

said force applicator including a fluid pressure responsive piston slidably received within a bore and connected to said linkage member to apply said downward force in response to fluid pressure within said bore;

each said rake including a downwardly depending spring secured at a frame end to said rake frame and a rake tip secured to said rake spring at a tip end of said rake spring distal said frame end; and, wherein said frame end leads said tip when said rake is in an operative position.

3. A raking device as claimed in claim 2 further comprising:

a fluid pressure supply system fluidly communicating with said bore through a first fluid conduit for supplying said pressurized fluid at a predetermined pressure and flow rate to said bore to act on a first face of said piston to cause said piston to exert said downward force;

said fluid pressure supply system including a fluid pressure bleed passage through which a portion of said pressurized fluid being supplied through said first fluid conduit to said bore is continually bled off at a volume flow rate determined by the pressure of said pressurized fluids, said fluid pressure bleed passage allowing an increase in said volume flow rate therethrough in response to an increase in pressure as would be occasioned by said piston being responding to an increase in said resultant force exerted by said rakes to enable said rakes to move upwardly in response to an increase in said horizontally directed force.

4. A raking device as claimed in claim 3 wherein:

said fluid pressure supply system includes a fluid reservoir, a fluid pump and a pressure reducing valve;

said fluid pump has an inlet in fluid communication with said fluid reservoir for receiving fluid from said fluid reservoir;

said fluid pump has an outlet for supplying pressurized fluid to said fluid pressure supply system;

said pressure reducing valve is interspersed between said pump and said first fluid conduit to control fluid pressure in said first fluid conduit;

said bleed passage has a flow restrictive orifice therein; and, said bleed passage discharges bled off fluid into said fluid reservoir.

5. A raking device as claimed in claim 4 wherein:

said fluid pressure supply system includes a second fluid conduit for supplying pressurized fluid to a second face of said piston opposite said first face, to cause said piston to exert an opposite force on said linkage member to move said rakes upwardly and a control valve to selectively direct said pressurized fluid between said first and second conduits.

6. A raking device as claimed in claim 5 wherein:

said pressure reducing valve includes a free flow bypass; and, said control valve is a three position four way closed center valve.

7. A raking device as claimed in claim 6 wherein:

said fluid is hydraulic oil.

8. A raking device as claimed in claim 2 having a plurality of said rake frames and wherein said rake frames are pivotally mounted to allow rocking of said rake frame about a horizontal axis generally parallel to said path of travel.

9. A raking device as claimed in claim 8 wherein:

said rake frame is pivotable about said axis to a position of about 10 degrees from the horizontal to either side.

10. A raking device as claimed in claim 9 wherein:

said rake frame support is a parallel bar linkage including at least two laterally extending generally parallel bars pivotably connected, one above the other, to said rake frame at one end and to said rake frame carrier at an opposite end.

11. A raking device as claimed in claim 9 wherein:

said linkage member is a bell crank having a first end pivotably connected to said rake frame, a second end opposite said first end pivotably connected to said force applicator, said bell crank being pivotably connected between said first and second ends to said rake frame carrier.

12. A raking device as claimed in claim 4 having a plurality of said rake frames and wherein said rake frames are pivotally mounted to allow rocking of said rake frame about a horizontal axis generally parallel to said path of travel.

13. A raking device as claimed in claim 12 wherein:

said rake frame is pivotable about said axis to a position of about 10 degrees from the horizontal to either side.

14. A raking device as claimed in claim 13 wherein:

said rake frame support is a parallel bar linkage having at least two laterally extending generally parallel bars pivotably connected, one above the other, to said rake frame at one end and to said rake frame carrier at an opposite end.

15. A raking device as claimed in claim 14 wherein:

said linkage member is a bell crank having a first end pivotably connected to said rake frame, a second end opposite said first end pivotably connected to said force applicator, said bell crank being pivotably connected between said first and second ends to said rake frame carrier.

16. A raking device as claimed in claim 7 having a plurality of said rake frames and wherein said rake frames are pivotally mounted to allow rocking of said rake frame about a horizontal axis generally parallel to said path of travel.

17. A raking device as claimed in claim 16 wherein:

said rake frame is pivotable about said axis to a position of about 10 degrees from the horizontal to either side.

18. A raking device as claimed in claim 17 wherein:

said rake frame support is a parallel bar linkage including at least two laterally extending generally parallel bars pivotably connected, one above the other, to said rake frame at one end and to said rake frame carrier at an opposite end.

19. A raking device as claimed in claim 18 wherein:

said linkage member is a bell crank having a first end pivotably connected to said rake frame, a second end opposite said first end pivotably connected to said force applicator, said bell crank being pivotably connected between said first and second ends to said rake frame carrier.

* * * * *

US006409424C1

(12) EX PARTE REEXAMINATION CERTIFICATE (5268th)

United States Patent
Crupi

(10) Number: US 6,409,424 C1
(45) Certificate Issued: Feb. 7, 2006

(54) ASPHALT RAKE WITH RIDE UP CAPABILITY

(75) Inventor: Francesco A. Crupi, 2845 Seabreeze Dr. South, Gulfport, FL (US) 33707

(73) Assignee: Francesco A. Crupi, Gulfport, FL (US)

Reexamination Request:
No. 90/006,483, Dec. 18, 2002

Reexamination Certificate for:

| | |
|---|---|
| Patent No.: | **6,409,424** |
| Issued: | **Jun. 25, 2002** |
| Appl. No.: | **09/592,773** |
| Filed: | **Jun. 13, 2000** |

(51) Int. Cl.
*E01C 23/12* (2006.01)

(52) U.S. Cl. ..... 404/94; 404/92; 404/93; 299/36.1; 172/684.5

(58) Field of Classification Search ..... None
See application file for complete search history.

(56) References Cited

U.S. PATENT DOCUMENTS

| | | | | |
|---|---|---|---|---|
| 3,970,404 | A | 7/1976 | Benedetti | 404/77 |
| 4,011,023 | A | 3/1977 | Cutler | 404/91 |
| 4,124,325 | A | 11/1978 | Cutler | 404/75 |
| 4,793,730 | A | 12/1988 | Butch | 404/77 |
| 4,946,307 | A | 8/1990 | Jakob | 404/91 |
| 5,044,819 | A | 9/1991 | Kilheffer et al. | 404/72 |
| 5,588,776 | A | 12/1996 | Swisher et al. | 404/72 |
| 5,791,814 | A | 8/1998 | Wiley | 404/91 |
| 5,848,755 | A | 12/1998 | Zickell et al. | 241/65 |
| 5,938,130 | A | 8/1999 | Zickell | 241/65 |
| 6,220,782 | B1 | 4/2001 | Yates | 404/75 |
| 6,290,152 | B1 | 9/2001 | Zickell | 241/21 |

FOREIGN PATENT DOCUMENTS

DE 3731716 A1 4/1988

OTHER PUBLICATIONS

Hot–in–Place brochure publicly distributed in 1997 ("1997 HIP Brochure," Exhibit 1.

Specifications by the Mich.Depmt of Transportation, Michigan Project STP 9674(004) dated Jun. 7, 1996 ("1996MDOT Specs," Exhibit 3).

*Primary Examiner*—Gary S. Hartmann

(57) ABSTRACT

A raking device for breaking up a surface has a plurality of rakes mounted on a rake frame and arranged to produce an upwardly directed result in force in response to a horizontally directed force arising from encountering an obstruction in a path of travel of the raking device. A rake frame support mounts the rack frame to a rake frame carrier structure and allows controlled movement of the rakes in a vertical direction. A force applicator acting between the rake from carrier and the rake frame support is provided to apply at least a downward force to the rake. The force applicator is responsive to an increase in the upwardly directed result in force above a preset amount to allow the rakes to move upwardly in response to the increase in force.

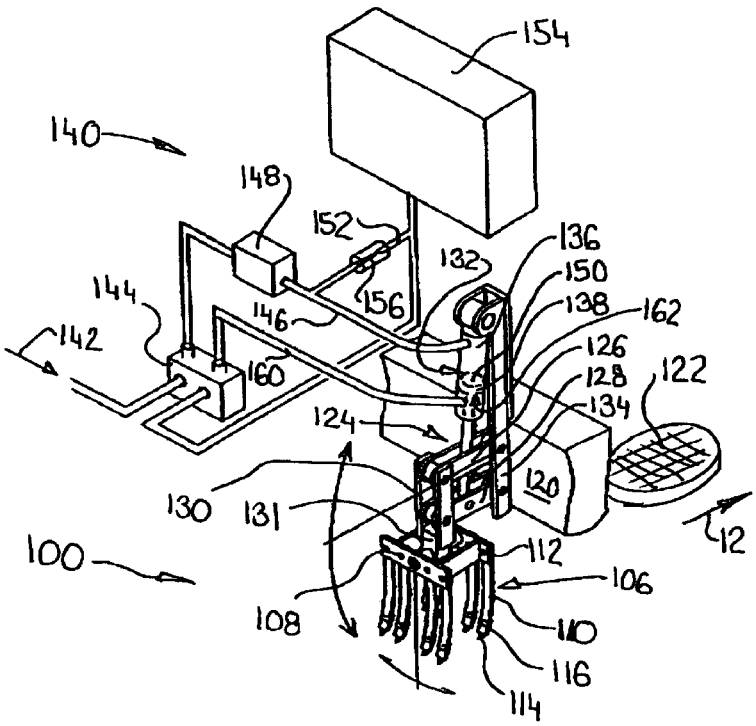

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–19 is confirmed.

Claim 1 is cancelled.

* * * * *